United States Patent [19]

Wolff

[11] 4,005,571

[45] Feb. 1, 1977

[54] ELAPSED TIME REMINDER WITH CONVERSION OF CALENDAR DAYS INTO ELAPSED TIME

[76] Inventor: Emanuel Wolff, 1241 Welsh Road, Huntington Valley, Pa. 19006

[22] Filed: Nov. 6, 1975

[21] Appl. No.: 629,511

[52] U.S. Cl. ..... 58/39.5; 235/78 R; 58/152 B

[51] Int. Cl.[2] ..... G04F 8/00

[58] Field of Search ..... 58/23 R, 50 R, 39.5, 58/141, 152 B, 16, 22.9, 145 A; 235/78, 61 A, 92 T, 92 PE

[56] References Cited

UNITED STATES PATENTS

| | | | |
|---|---|---|---|
| 2,437,621 | 3/1948 | Strate | 235/78 |
| 2,892,304 | 6/1959 | Eaves | 235/78 X |
| 3,610,753 | 10/1971 | Neubauer | 58/39.5 |
| 3,877,216 | 4/1975 | Mounce et al. | 58/39.5 |
| 3,889,875 | 6/1975 | Goodhouse | 235/61 A |

*Primary Examiner*—Ulysses Weldon
*Attorney, Agent, or Firm*—Alfred B. Levine

[57] ABSTRACT

An elapsed time display and reminder device that is manually adjustable by the user to select a time in the future that may be many days in advance of the present, and to provide a calibrated countdown display of the progressively diminishing time interval until the selected future time is reached. In a preferred device, the user enters the present time and the future time in calendar form as a month and day of the month, and the device automatically converts this future calendar date less the present date, into an elapsed time interval as a number of days.

11 Claims, 3 Drawing Figures

ELAPSED TIME REMINDER WITH CONVERSION OF CALENDAR DAYS INTO ELAPSED TIME

STATEMENT OF THE INVENTION AND BACKGROUND

This invention relates to timing devices that are manually settable as to future time, and are provided with suitable displays to advise the user as to the time remaining and with alarms to notify the user when the elapsed time has expired. The invention is particularly adapted for use as a miniaturized electronic reminder that may be readily carried in the hand, pocket, or purse and that is capable of being manually set to provide a warning during and an alarm following a long time interval of days, many days, a year, or even longer.

There is often a need for a "long time" interval reminder, to alert users of an appointment or important event, or periodic function, that may be many days in the future. For example, persons often need to be reminded of the ordinary long term future appointment dates with doctors and dentists, or of periodic preventive health care as recommended in the field of cancer, as well as of special events including important social events and other activities of a non-recurring nature.

Additionally, in the fields of business and the professions, it is often customary for the user to maintain a written time log or diary for recording future appointments and business events yet in the rush and press of business matters, the user sometimes neglects to consult his log and is embarrassed by failure to prepare sufficiently for and to attend to an important duty or function.

Although many watches, clocks, desk timers and the like are provided with settable alarms, such devices generally operate only within a short twenty-four hour, one day, time interval, and are therefore not useful for long term time reminder purposes that may extend to many days in the future. Such devices also generally do not display a countdown sequence.

SUMMARY OF THE INVENTION

Briefly, according to the present invention there is provided an electronic "calendar" reminder that is adjustable to select future times that may involve days and even months in advance, yet is capable of being embodied in a miniature personalized device that is small enough to be carried in the hand, pocket, or purse; or alternatively to be used in business and home as a small desktop unit.

In a preferred arrangement, the device is manually presettable to enter a future calendar date in the form of a month and a day, and to also enter the present month and day. The device automatically converts these calendar entries to provide and display the total time interval in days from the present to the selected future time. An adjustment is also provided in this automatic conversion means for correcting for the different number of days in February in each Leap year. When used as an automatic reminder, the preferred embodiment further includes an electronic clock and controls for providing a time countdown of this total interval time, together with a suitable alarm and warning when this time has elapsed or expired. By providing the display of the elapsed time interval as a progressive countdown of days instead of a count-up, the user is continually advised as to the amount of time (number of days) remaining until the selected future time.

In a more simplified embodiment, the automatic conversion of the present and future calendar dates to an elapsed time interval number can be replaced by a suitable non-automatic means such as a printed calendar, slide rule, or the like, thereby permitting the user to independently determine or calculate the elapsed interval, and to manually enter this time interval number into the electronic reminder instead of entering the calendar dates as in the fully automatic electronic device.

DETAILED DESCRIPTION OF PREFERRED EMBODIMENTS

Figure 1:
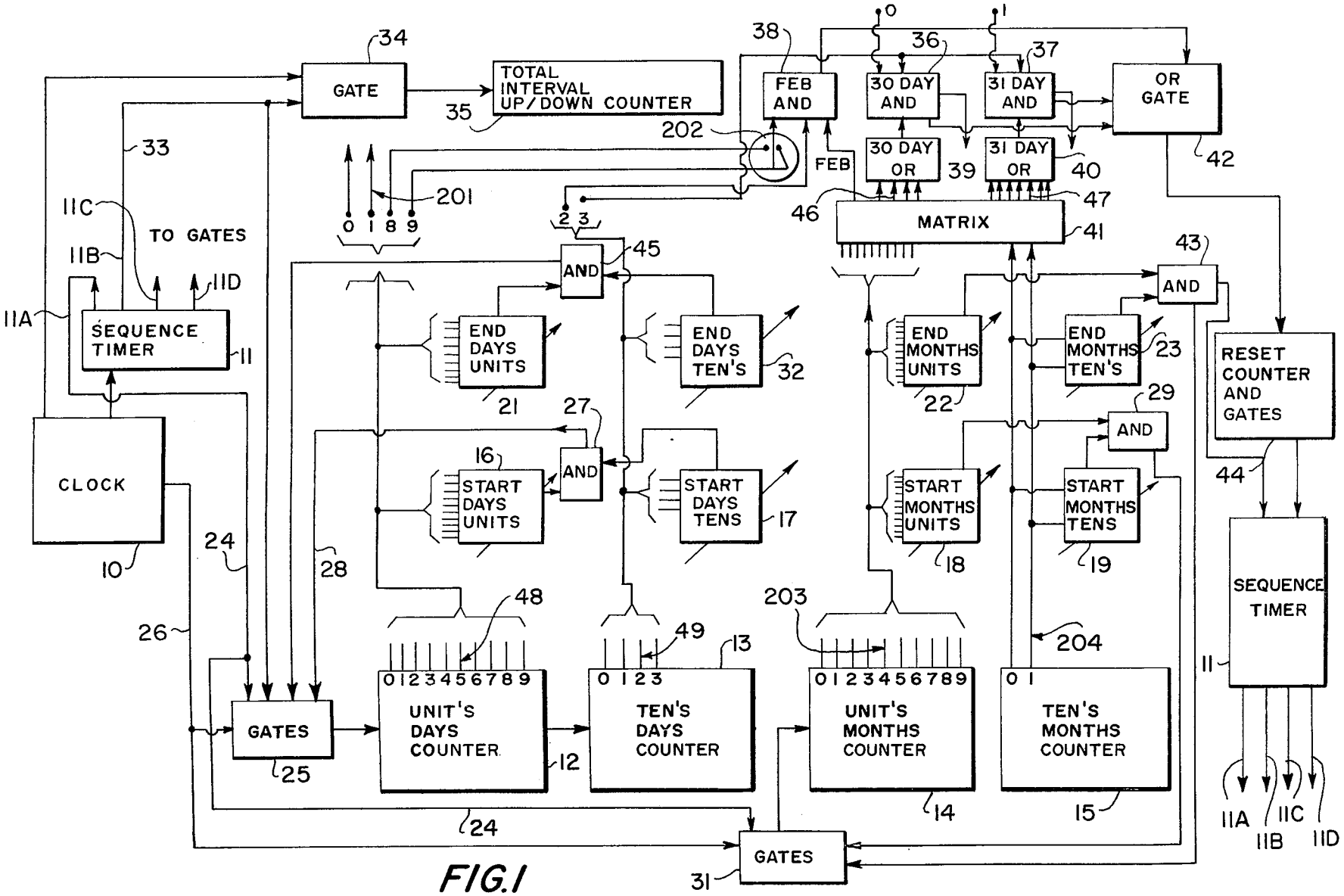
FIG. 1, is an electrical block diagram showing a preferred electronic embodiment having manual entry of the present and the future calendar dates and automatic conversion to yield the total time interval in a number of days.

FIG. 1 shows a preferred electronic circuit for automatically converting manual inputs or entries in the form of "START" days and months, and "END" days and months, into a digital number (eg. elapsed time interval) corresponding to the total number of days between the present calendar day and month (eg. START) and the future calendar day and month (eg. END) when the user wishes to be remainder of an important event. In the circuit of FIG. 1, the circuitry enables the entry and conversion of calendar dates in days and months for any time interval up to one year. However, as will be appreciated by those skilled in the art, the circuit may be extended to much greater periods of time in tens of years or even more. It will also be appreciated that the system may be further extended to more precise time intervals less than one day to hours, minutes, seconds, or even lesser measure of time. For example, by extending the circuitry, the time interval between START and END may be calculated in terms of years, months, days, hours, minutes, seconds, and even lower.

Returning to FIG. 1, the preferred circuit includes a precision crystal controlled electronic clock 10 providing a series of pulse outputs at different frequencies, a sequence timer circuit 11 that is pulsed by the clock 10 to provide timing control outputs signals; a pair of counters 12 and 13 for counting "days", and "tens" of days; and a pair of counters 14 and 15 for counting "months" and tens of months. Each of these four counters is provided with an associated manual selector switch for entering both the START days and months and the END days and months so that the user may manually enter into the circuit any one of the future months (eg. END) from January to December (1 to 12), by suitably adjusting the END selector switches 22 and 23 to their proper number; and may enter any one of the future days in this selected END month (from 1 to 31) by suitably adjusting the END days selector switches 21 and 32 to their proper number. The user also manually enters into the circuit the present time as a calendar month and day by suitably adjusting the START month selector switches 18 and 19 and the START days selector switches 16 and 17. Following this manual entry of the present and future times in calendar date form, the circuit is energized to automatically convert the calendar day entries into a time interval in the form of a digital number representing the number of days between the present day (START) and the future day (END). This digital number representing the future "elapsed" time automatically determined by the circuit and registered in the interval up/down counter 35 of FIGS. 1 and 3, as will be seen, is also displayed in the circuit of FIG. 3 so that the user immediately observes the total interval or number of days between the present day and the future day selected for the important event. As will be seen in FIG. 3, after such manual entry and display, the operation of the circuitry is completely automatic, and the displayed number of days is automatically reduced by one, for each passing day into the future in a count-down manner. In this way, the user is continually reminded each day of the remaining number of days left until the final day of the event.

In the first operation of the circuit, application of a reset switch enables the clock 10 to advance the sequence timer 11 to energize its first output line 11A that, in turn, closes the Gates 25 and 31 by energizing line 24. The clock pulses over line 26 are applied through closed gates 25 and 31 to successively advance the days counters 12 and 13, and the months counters 14 and 15 until each of these counters has been advanced to the correct number that has been manually entered into the START selector switches for days 16 and 17, and for months 18 and 19. When the correct number of pulses corresponding to the days has been entered into days counters 12 and 13, an AND circuit 27 responds to the output from START selector switches 16 and 17 and energizes gate 25 over line 28 to open and prevent further pulsing of the "days counter" by clock 10. Similarly, when the correct number of months has been entered into the months counters 14 and 15, an AND circuit 29 is energized by the joint response of START months selector switches 18 and 19 to deenergize the Gate 31 and prevent further advance of the months counters 14 and 15. In this first operation, therefore, the days counters 12 and 13 and the month's counters 14 and 15 are automatically advanced to the start or present date that has been manually set into the START selector switches 16, 17, 18, and 19.

In the second and succeeding operation of this circuit, the number of "remaining" days in the START, or present month, is automatically determined, and a digital number corresponding to such remaining days is entered into the time interval up/down counter 35. This function is performed by the clock 10 advancing the sequence control timer 11 to its next output position 11B, serving to close gate 34 leading to the interval counter 35, and also to close gate 25 leading to the day's counter 12 and 13. Clock pulses are then simultaneously applied to advance both the days's counters 12 and 13 and the time interval up/down counter 35, and such counters are both advanced until a remaining number of days have been added to the days counters 12 and 13 corresponding to the end of that START month. To automatically determine the remaining number of days in the START month, a matrix 41 is coupled to the output lines 203 and 204 of the month's counters 14 and 15. Since the months of April, June, September, and November each have 30 days and the remaining months have 31 days, except for the month of February; the four output lines of months counters 14 and 15 corresponding to the count number 4 (April); count number 6 (June), count number 9 (September); and count number 11 (November); are each coupled by the matrix 41 to a "30 day" OR circuit 39. In a similar manner, the output lines of the month's counter 14 and 15 for the count numbers (months) of 1, 3, 5, 7, 8, 10, and 12, are coupled by the matrix 41 to a "31 day" OR circuit 40. Thus, whenever the months counters 14 and 15 have a count of either 4, 6, 9, or 11, only the 30 day OR circuit 39 is energized, and whenever the months counters 14 and 15 have a count of 1, 3, 5, 7, 8, 10, or 12, only the 31 day OR circuit 40 is energized. Presupposing, that the START month (manually entered) is a 30 day month, the 30 day OR circuit 39 has been energized by the initial entry of the START month into months counter 14 and 15. In this event, when the days counters 12 and 13 are advanced to count from START number to the number 30, the output lines 48 and 49 from the day's counter corresponding to the number 30 are energized. These output lines are connected to a 30 day AND circuit 36 which is also energized by the 30 day OR circuit 39 whenever the START month is a month having 30 days. Consequently, the 30 day AND circuit 36 accordingly responds to this joint energization from both the day's and month's counters, and produces a "stop" energization to OR gate 42 to, in turn, close the gates 25 and 34 and stop further clock pulses from entering the total time interval up/down counter 35, and the day's counter 12 and 13. Accordingly, the presetting of the months's counters 14 and 15 according to the START month determines the total number of days remaining in the START month, and permits a number of days to be added into the total time interval counter 35 corresponding the number of days still remaining in the START month.

In the event that the preselected START month is one having 31 days, the operation is the same but in this case the 31 day OR circuit 40 is energized instead of the "39 day" OR circuit. Therefore, only the 31 day AND circuit 37 receives energization, and the day's counters 12 and 13 will be advanced until reaching the count of 31 before the 31 day AND circuit 37 is actuated to operate the "OR" gate 42 and stop further counting. For the month of February, corresponding to a count of "2" in the months's counters 14 and 15, the matrix 41 energizes only the February AND circuit 38 and not the 30 day or circuit 39 or the 31 day OR circuit 40. The output terminals of the day's counters 12 and 13 corresponding to a count of either 28 or 29 are also connected to the "February" AND circuit 38. Consequently, when the day's counter's 12 and 13 have been advanced to the number 28 or 29, the February AND circuit 38 is operated to, in turn, stop further counting in the same manner as discussed above. Except for leap year, the month of February has 28 days whereby switch 202 applies the "8" count terminal from day's counter 12 to the February AND circuit 38 so that the circuit responds to 28 pulses. On the other hand, during leap year, the switch 202 is manually settable by the user to its other contact, preferably labeled "LEAP YEAR" and this connects the "9" count terminal of days counter 12 to the February AND circuit 38 so that this circuit is actuated by a day's count of 29 during leap year. Thus, in this second operation of the circuit, the day's counters 12 and 13 are advanced until counting the remaining number of days in that selected START month, and the same count of "remaining" days in the START month is applied to the total time interval counter 35. Additionally, upon completion of this remaining days count, the OR Gate 42 and Reset circuits resets the day's counters 12 and 13 to "O", and applies one pulse to the month's counters 14 and 15, to advance the month's counters 14 and 15 to the next succeeding month after the START month.

Following this second operation, the clock 10 advances the sequence control timer 11 to its next output position energizing output line 11C. This functions to close gates 25 and 34 and apply clock pulses to day's counters 12 and 13 and also to total time interval counter 35 so as to accumulate the number of days in the next succeeding month following the START month. The operation is similar to that described above in that the setting or count position of the months counter's 14 and 15 energizes the proper one of the 30 day AND gate 36, or the 31 day AND gate 37, or the February AND gate 38, limiting the day's counters 12 and 13 to adding the correct number of days for that month and then be stopped and be reset for the next succeeding month; and also the advancing the month's counters 14 and 15 to the next following month. It is to be specifically noted that the total time interval counter 35 is not reset after each counting of days operation but instead accumulates the total number of days (eg. pulses) for all succeeding months, following the START month, as well as adding the remaining days in the START month, as discussed above.

After the number of days in each succeeding month is added to the total time interval counter 35, the operation is repeated for the next month until the last or END month is reached, as has been previously entered into the selector switches 22 and 23. The advance of the month's counters in the END month operates the AND circuit 43 through input selector switches 22 and 23 to advance the sequence timer 11 to energize its line 11D for controlling the final counting operation. As before, the gates 25 and 34 are operated to pulse the day's counters 12 and 13 and to also add the pulses into the total time interval counter 35. However, for the END month, the day's counters 12 and 13 are advanced only to the preset END days setting that was originally entered into selector switches 21 and 32; and upon the occurence of such preset number of days, the END AND circuit 45 is operated by the day's counter to deenergize the gates 25 and 34 and to discontinue the functioning of the circuit. In this final operation, the sequence counter is advanced to its next state powering line 11E which is the normal "Run" state. Pressing the "Reset" switch resets all counters and all the foregoing is repeated. The "Run" state is equivalent to the start of FIG. 3 as will be described.

Briefly, recapitulating the mode-of-operation of this preferred conversion circuit, the present time (START month and day) and the future time desired (END month and day) are manually entered into the unit by manually adjusting the START and END selector switches 16 to 19 and 21 to 23 and 32. Thereafter, the circuit is started to perform a series of cycles of operation. In the first operation, the START days and months are automatically entered into the day's counters 12 and 13 and into months counters 14 and 15, but the total time interval counter 35 is not advanced. In the next operation, the day's counters 12 and 13 are advanced to a count corresponding to the future remaining days of the START month, and this counter 12, 13 is then stopped and reset. This operation of the day's counters 12 and 13 controls the entry of a count equaling the same number of remaining days in the START month into the total time interval up/down counter 35. The month's counters 14 and 15 are then advanced to the next month, and the day's counters 12 and 13 are again pulsed to control the entry of an additional count into the total time interval counter 35 corresponding to the number of days in the next month. The total time interval counter 35 is similarly pulsed in each subsequent operation, to accumulate the number of days in each succeeding month to those already in this counter 35 until reaching the last or END month, as manually set into the unit. In the final operation, only the number of END days entered into the selector switches 21 and 32 are applied as pulses to the total time interval counter 35. Thus, the final number or count in the total time interval counter 35 comprises the total number of future days from the present or START date, until the preselected future date (eg. END month and day) obtained by successively counting the total number of future days in each month from START to END.

Figure 2:
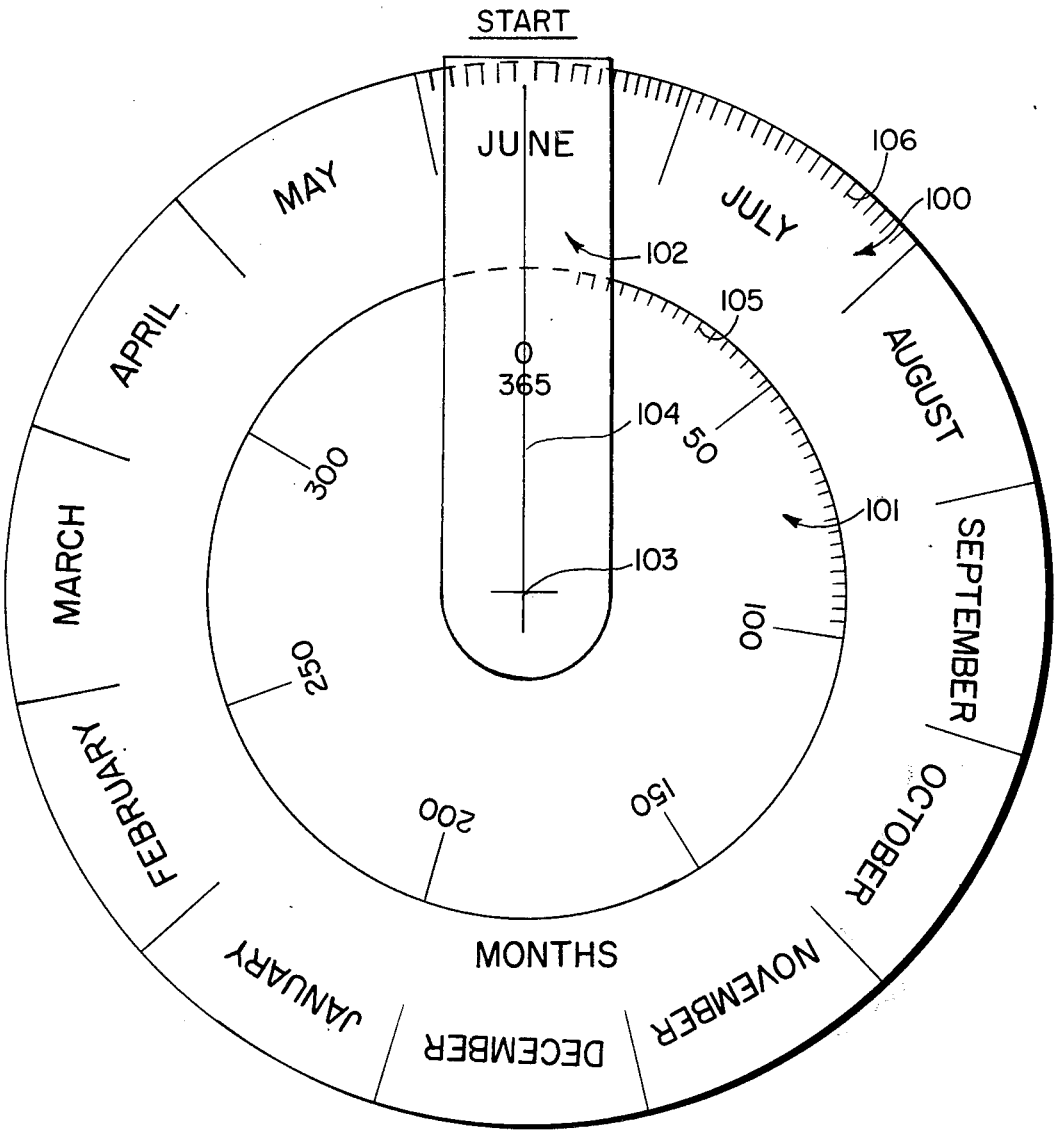
FIG. 2, is a plan view of a circular slide rule for converting calendar months and days into an elapsed time interval as a number of days.

FIG. 2 illustrates an alternative embodiment using a circular slide rule for enabling a user to manually calculate the number of future days in the interval from START to END by manually adjusting the scales instead of using the automatic electronic circuit of FIG. 1. As shown, the slide rule comprises a large circular disc 100, a smaller circular disc 101, and a transparent indicator 102, all being concentrically fastened together for relative circular movement about the central pivot 103. The periphery of the outer disc 100 is marked with uniformly spaced markings 106 for the days of each month, with the days in each month being numbered in sequence and labeled by that month, as shown. The inner disc is similarly marked with uniformly spaced markings 105 corresponding to the days, and with the markings being consecutively numbered from 0 to 365 on an annual basis, as shown. The transparent indicator 102 contains a straight indicator line 104 extending from the pivot center 103 to the peripheral day markings 106 on the outer disc 100. For calculating the number of days between START (eg. present date) and END (eg. future date), the discs are angularly displaced and the indicator line 104 is used to align the START date, (month and day) on the outer disc 100 with the 0 day marking on the inner disc 101. Thereafter, the inner and outer discs 100 and 101 are maintained in this same relative angular position, and the indicator line 104 is angularly advanced to the END date marking 106 on the outer disc 100. The accumulated number 105 then indicated on the inner disc 101 by the indicator line 104 corresponds to the future time interval in number of days between START calendar date and the END calendar date.

Figure 3:
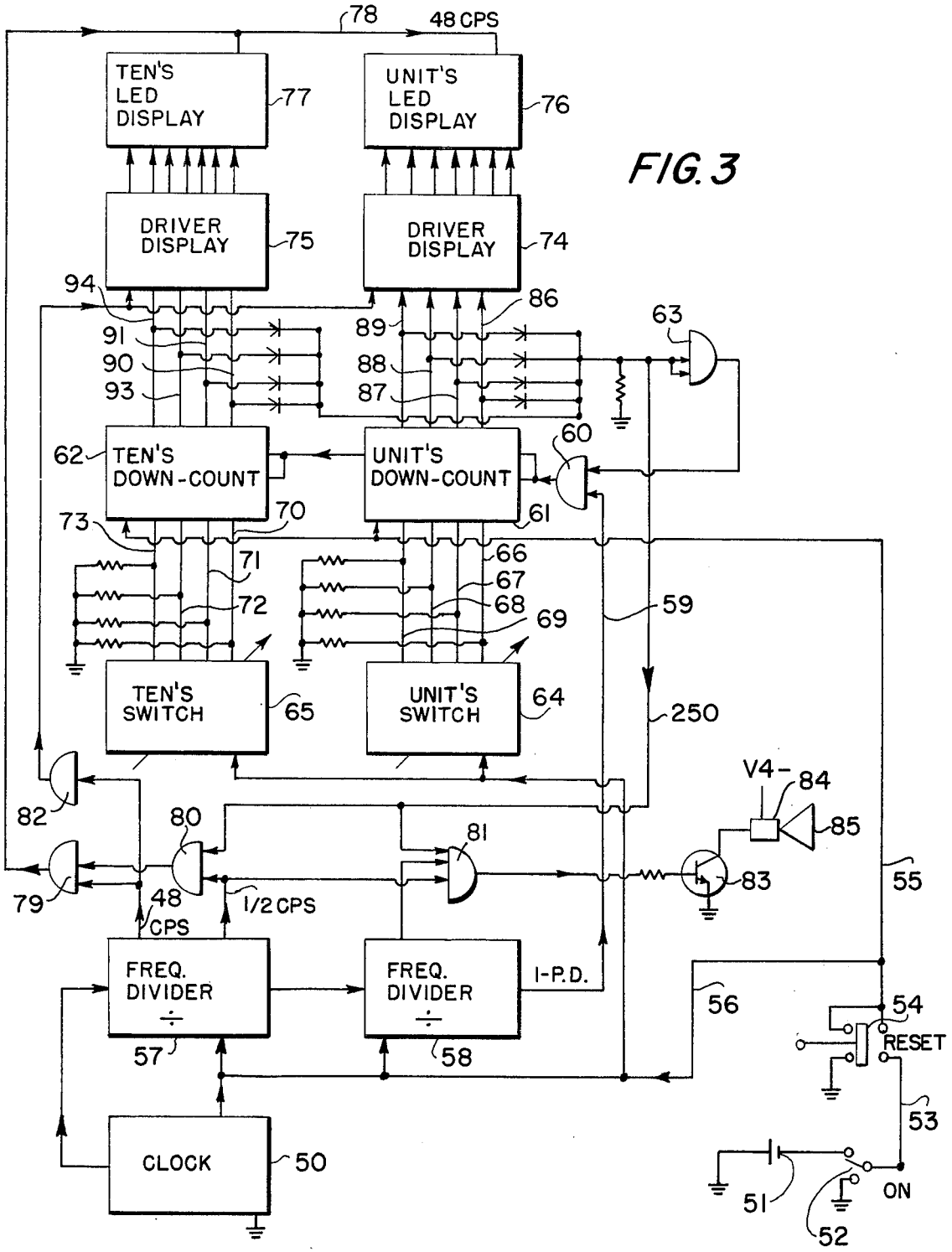
FIG. 3, is an electrical schematic drawing of a preferred electronic embodiment provided with manual entry of the elapsed time as digital number and automatic display and count-down.

FIG. 3 illustrates a preferred embodiment for the reminder portion of the circuit to be added to FIG. 1 that functions to continually indicate on a day-by-day basis, the number of days remaining until the preselected END day. The preferred circuit of FIG. 3 also provides a visual indication or display when the END day arrives by means of LED or LCD display stages 76 and 77, as well as providing an audible warning or indication when the preselected END day has arrived.

In FIG. 3, the total number or "interval" of days, from START to END, is initially entered into the total time interval up/down counter stages 61 and 62. In a completely automatic system of FIG. 1, the number entered into this counter 61, 62 is automatically determined by the circuitry of FIG. 1 calculating the difference between the two dates and entering the number, whereas in the manual calculation mode of FIG. 2, the total time interval in days is determined by using the slide rule as shown. The user then manually inserts the total time interval by appropriately setting a units selector switch 64 and a tens selector switch 65 (FIG. 3) according to the computed number of days in the interval.

The selector switches 64 and 65 apply a predetermined voltage level to the proper binary stages of the counters 61 and 62 thereby to preset the total interval counter 61, 62 to the total time interval in days. Following this entry, a start switch 52 is actuated enabling the electronic clock 50 to pulse the concatenated frequency divider stages 57 and 58. The frequency of the crystal controlled clock 50 taken with the ratio of frequency division of the divider stages 57, 58 is chosen to provide a low frequency output pulse rate over line 59 of one pulse per day, and this pulse rate is applied to the time interval counter 61, 62 over line 59 and through gate 60, in subtractive relationship, to successively reduce the number or down-count the number therein by one unit each day. The binary stages of the counters 61, 62 are connected over output lines 86 to 89, inclusive, and over 90, 91, 93, and 94 to the display driver circuits 74, 75 that, in turn, convert the binary coded output of counter stages 74, 75 to energize the units display circuits 76 and tens display 77 in the decimal number system. A forty-eight cycle per second pulse rate is also obtained from the frequency divider 57 and applied over line 78 to energize the decimal number display units 76 and 77, to provide a continual display of the remaining number in counter 74, 75. Thus, the circuit provides a continual numerical display of the number of days or time interval still remaining before the preselected future day; and this number is successively reduced by one unit as each succeeding day passes to provide a day-by-day countdown as the elapsed time interval expires.

When the time interval has fully expired by the passage of the present number of days and tens of days of the time period, the output lines 86 to 89 of units counter stage 61, and lines 90, 91, 93, and 94 of ten's counter stage 62 are all reduced to their zero condition. At this time, the stop gate 63, coupled to all these output lines through diodes as shown, is energized to stop the count-down operation by producing a stop pulse to deenergize gate 60 and prevent further clock pulses over line 59 from being applied to the interval counters 61 and 62. At this time, the display stages 76, 77 visually show the decimal number 0—0 corresponding to the zero condition of the interval counters 61 and 62.

For additionally warning or signaling the user that the desired day has finally arrived, the preferred visual display circuit also commences to operate in a flashing mode, cycling at a rate of once every other second. Still further, an audible signaling device such as a horn or buzzer 85 is energized to notify the user that the END day has arrived.

These functions are performed by providing an additional END output signal from the output lines of the counters 61 and 62 over line 250 for energizing AND gate 80. AND gate 80 is also energized by a ½ cycle per second signal from frequency divider 57, and therefore when energized by the END interval signal over line 250, it commences to pulse the next gate 79 in an on-off fashion at the rate of ½ cycle per second, or once every two seconds. This gating function repetitively switches the 48 cycle per second indicator energizing signal on and off to flash the indicators 76, 77 at this rate of once every other second.

The END interval gating signal over line 250 also energizes the gate 81 to, in turn, energize transistor switch 83 for cycling the audible signaling device 84, 85 to further warn or signal, in an attention directing manner, that the END day or date has arrived. The flashing light indicator signals and the audible signaling continues until the user operates reset switch 54 to momentarily disconnect the ground line from return lines 55 and 56, and momentarily apply the battery potential from line 53 over the ground lines to reset the counters, frequency dividers, and other circuitry as is needed.

It will be noted that the circuit of FIG. 3 includes only a units and tens counter to provide for only a maximum time interval measurement of operation up to 99 days. However, additional stages of counters, display units, selector switches, and other units may be provided, as desired, for extending the range of operation to longer time intervals in hundreds of days, or to short time intervals of less than one day; such as hours, minutes, seconds, or even less. Since these and other changes may be made, this invention is to be considered as being limited only by the following claims:

What is claimed is:

1. An electronic reminder comprising:

first means for manually entering the present time, second means for manually entering a selected future time desired, electronic means for obtaining the elapsed time interval between the present and selected future time, an electronic timer associated with said electronic means for counting the elapsed time between the present and selected future times as it expires, and indicator means responsive to said electronic means and timer means for signaling the completion of said elapsed time.

2. In the reminder of claim 1, said timer including a digital counter and means for entering said elapsed time into said counter as a multi-digit number, and said first and second means being manually operated for entry of the present time and future time on a calendar basis.

3. In the reminder of claim 1, said electronic means including a digital counter and means for entering the elapsed time interval as a multi-digit number therein, and said electronic timer including an electronic clock for successively diminishing the multi-digit number corresponding to the elapsed time until the selected future time.

4. In the electronic reminder of claim 1, said first and second means being individually manually operated to enter the present time and future time on a calendar basis including months and days, said electronic means deriving the time interval therebetween as a digital number of days, and said electronic timer counting the elapsed time between the present and selected future time as a digital number.

5. In the electronic reminder of claim 1, said indicator means continually displaying the time interval remaining until completion of the elapsed time.

6. In the electronic reminder of claim 1, said indicator means providing a continual digital count-down of the time interval remaining until completion of the elapsed time.

7. In the electronic reminder of claim 1, said first and second means enabling manual entry of the present time and future time on a calendar basis, including month and day, said electronic means automatically determining the number of elapsed days in digital number form in the interval between the two times, said timer means successively counting the days and with said electronic means, energizing said indicator means to signal the completion of said elapsed time.

8. In the electronic reminder of claim 1, manual means for correcting said electronic means for variations during leap year.

9. An electronic reminder comprising:

means for manually entering an adjustable selected future time desired, means for calculating the adjustable elapsed time between said adjustable selected future time and the present time and deriving a adjustable digital number corresponding to said elapsed time, means including a digital register combined with said means for calculating the elapsed time for storing and displaying said adjustable digital number, an electronic clock, and electronic means including said register and clock for progressively diminishing said adjustable digital number in proportion to the passage of time until said elapsed time has been completed.

10. In the reminder of claim 9, said calculator means including counters for days and months, a control counter, and a logic circuit energized by said clock, said logic circuit being sequentially energized by said control counter and by said manual entry means to enter an accumulated digital number into said register corresponding to the sum of the number of days in each month between the present time and the selected future time.

11. In the reminder of claim 10, said logic circuit including means for adjustably presetting said counter for days to a count capacity that differs for each month according to the number of days in that month, and manual entry means for correcting the capacity of said counter for the month of February at leap year.

* * * * *